United States Patent [19]

Stelcher

[11] 4,362,145

[45] Dec. 7, 1982

[54] PRACTICE WEAPON INCLUDING PELLET GUN MOUNTED WITHIN MISSILE FIRING TUBE

[75] Inventor: William N. Stelcher, Deerfield, Ill.

[73] Assignee: Kinetronics Corporation, Lake Bluff, Ill.

[21] Appl. No.: 219,222

[22] Filed: Dec. 22, 1980

[51] Int. Cl.[3] ..... F41F 27/00; F41B 11/06

[52] U.S. Cl. ..... 124/32; 42/84; 124/40; 124/58; 124/77; 434/12

[58] Field of Search ..... 124/58, 32, 40, 77, 124/28; 434/11, 12, 19, 24; 89/29, 28 R, 28 A, 135; 42/77, 70 E, 84

[56] References Cited

U.S. PATENT DOCUMENTS

| | | | |
|---|---|---|---|
| 741,079 | 10/1903 | Tasker | 89/29 |
| 2,061,341 | 11/1936 | Aigner | 124/58 |
| 2,110,509 | 3/1938 | Von Latscher-Latka et al. | 124/58 |
| 2,322,212 | 6/1943 | Allen | 434/24 |
| 2,605,756 | 8/1952 | Bertschinger | 124/58 |
| 2,674,923 | 4/1954 | Brandt | 434/12 |
| 3,088,225 | 5/1963 | Amistadi | 434/24 |
| 3,112,671 | 12/1963 | Dunham et al. | 434/12 |
| 3,339,304 | 9/1967 | Knode, Jr. et al. | 42/77 |
| 3,352,047 | 11/1967 | McDonnell | 42/70 E |
| 3,374,708 | 3/1968 | Wall | 124/32 X |
| 3,899,845 | 8/1975 | Wild et al. | 42/84 X |
| 4,143,636 | 3/1979 | Liepins et al. | 124/40 |

FOREIGN PATENT DOCUMENTS

| | | | |
|---|---|---|---|
| 1524311 | 9/1978 | United Kingdom | 124/32 |

OTHER PUBLICATIONS

"Electric Gunsmoke", *Sports Illustrated*, vol. 12, No. 18, May 2, 1960, pp. 68–70.

*Primary Examiner*—Richard T. Stouffer

*Attorney, Agent, or Firm*—Hill, Van Santen, Steadman, Chiara & Simpson

[57] ABSTRACT

A practice device which allows the simulation of firing of a weapon such as a light antitank weapon wherein the weapon can be fired in an armory for practice by soldiers without requiring the actual tactical missile to be fired which requires a large firing range with extreme protection of personnel. The invention comprises attaching a gas powered pellet gun within the barrel of the missile launcher and loading such pellet gun with a round of ammunition after which the gun is cocked and the weapon is sighted toward a target provided therefore and the pellet gun is fired with a suitable trigger for simulating and practicing actual use of the weapon. When the trigger is depressed it causes a solenoid to be momentarily energized, which draws a sear away from a firing cylinder causing actuation of a valve to fire the pellet gun. The pellet gun is mounted to a pair of disc shaped members which are receivable within the barrel of the missile launcher and can be locked to the barrel such that the sights of the missile launcher can be used for firing the pellet gun.

4 Claims, 6 Drawing Figures

PRACTICE WEAPON INCLUDING PELLET GUN MOUNTED WITHIN MISSILE FIRING TUBE

BACKGROUND OF THE INVENTION

1. Field of the Invention

This invention relates in general to an In/Law simulator which allows practice with expended light antitank weapons which are fitted with a subcaliber air gun and mounting fixture with trigger for simulating firing in small or confined range areas.

2. Description of the Prior Art

Portable rocket launchers are utilized by troops for defending against enemy tanks and other targets, for example, 66 mm light antitank weapons (LAW) systems are loaded with rockets which when fired in practice must be utilized in firing ranges where personnel are provided protection to prevent injury from the missile and the back blast area. Thus, it is very expensive to provide firing practice with such missiles and the accuracy and effectiveness of the missile depends on the familiarity and practice which the user has had.

SUMMARY OF THE INVENTION

The present invention allows soldiers to inexpensively train with light antitank weapons and is well suited for armory use and gives actual firing experience to soldiers continuously so that they can improve their performance in the use of the weapon. The invention provides for attaching a gas powered pellet gun within the barrel of the weapon of an expended weapon and the pellet gun is fired by depressing the actual trigger of the light antitank weapon. The simulator can be fired in small or confined range areas such as an armory and thus the soliders can practice year round with very little effort and expense.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
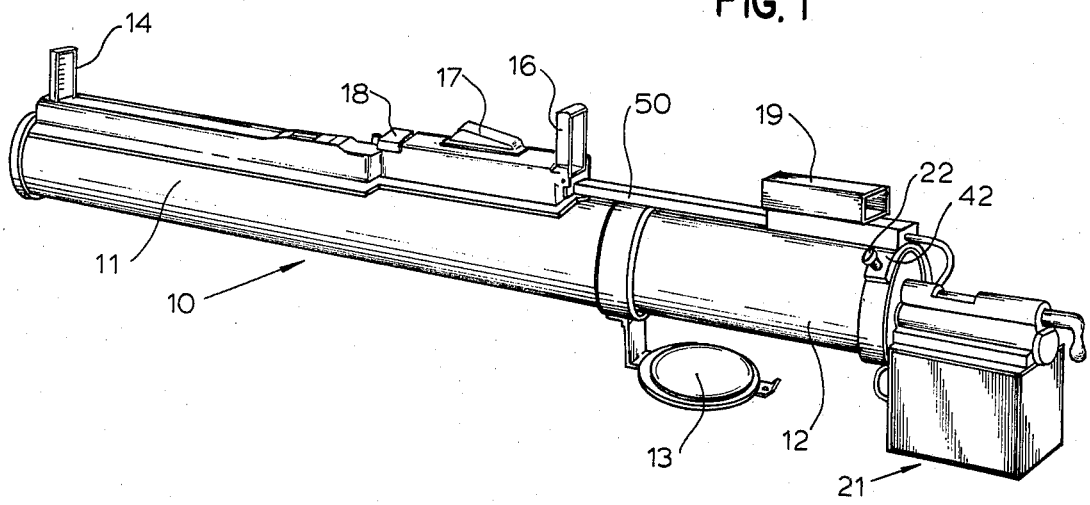
FIG. 1 is a perspective view of the invention.

FIG. 1 illustrates an antitank weapon 10 which has a front barrel portion 11 and a telescoping back barrel portion 12. A pivoted cover member 13 covers the end of the back barrel 12 when in the telescoped position before the antitank missile has been fired. The present antitank weapon 10 has been fired so that the missile is no longer in the weapon and the compressed gas pellet gun of the invention 21 is installed therein. The weapon 10 has a front sight 14, a back sight 16, a safety 18 and a firing trigger 17 and a receptacle 19 into which the back sight 16 folds and is received with the weapon has been telescoped together. The pellet gun 21 is held by a set screw 22 received in a portion 42 as illustrated in FIG. 1 and FIG. 3 for example.

Figure 2:
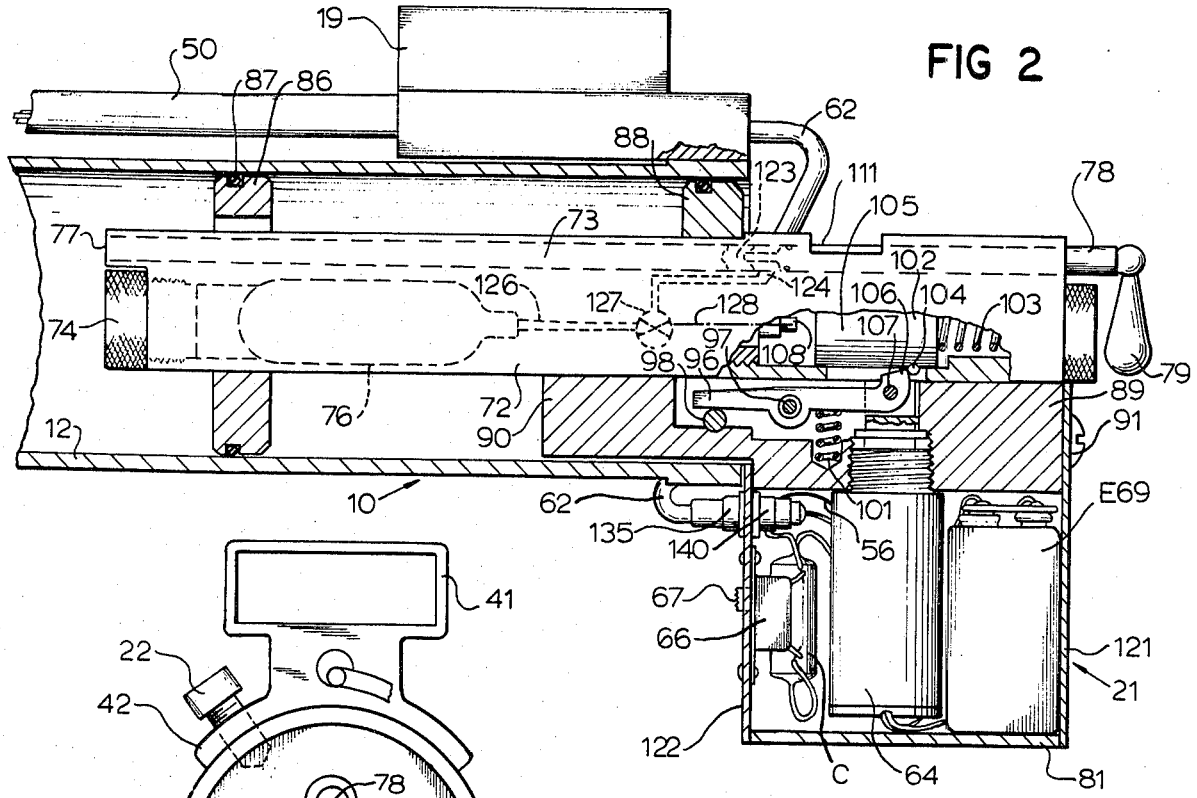
FIG. 2 is a sectional view illustrating the invention mounted in an antitank missile.
Figure 3:
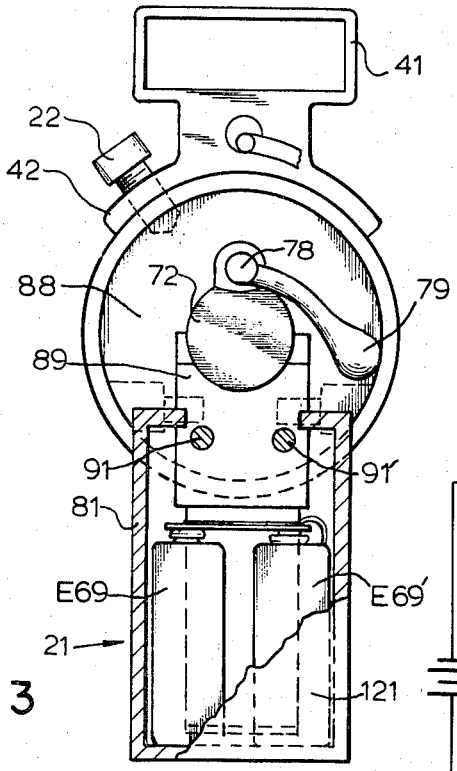
FIG. 3 is an end view illustrating the invention.

As shown in FIGS. 2 and 3, the pellet gun of the invention comprises a tube 72 into which a $CO_2$ cartridge 76 can be received by removing the cap 74 from the tube 72. A barrel 73 is mounted to the top portion of the tube 72 and has a firing end 77 and a firing chamber for receiving a pellet 123. The tube 72 is mounted on a block 89 which has a portion 90 that is received in the tube 12 of the weapon 10 and a first disc-shape member 86 is formed with a groove and carries an O-ring 87 of flexible material so as to engage and center the front end of the tube 72 and barrel 73 when the pellet gun 21 is inserted into the tube 12. A rear disc 88 engages the rear portion of the tube 12 and the set screw 22 passes through the member 42 and is engageable to lock the pellet gun 21 to the tube 12.

The pellet gun is fired by rotating the handle 79 which turns the bolt 78 so that it can be unlocked and retracted such that a pellet 123 can be placed into the chamber of the gun after which the handle 79 is returned to the position shown in FIGS. 2 and 3 after rotating and pushing the bolt 78 to the left relative to FIG. 2. By turning and actuating the bolt, the bolt cocks the firing cylinder 105 which is biased by a spring 103 to the left relative to FIG. 2. A sear 96 is pivoted on a pivot pin 97 and has an engaging portion 106 that engages a projection 104 on the firing cylinder 105. A spring 101 holds the sear 96 in the position illustrated in FIG. 2 so as to maintain the pellet gun in the cocked position. A solenoid 64 has a pin 107 which engages the sear 96 so as to move it downwardly when the solenoid 64 is energized to fire the weapon. The firing cylinder 105 hits a firing pin 108 which actuates a valve 127 with a linkage 128 so that compressed gas from the cartridge 76 passes through the tube 126 through the valve 127 to a tube 124 which connects with the firing chamber to eject the pellet 123 from the gun.

The spring 101 biases the sear 96 in the counterclockwise position relative to FIG. 2 so that the portion 106 holds the firing cylinder 105 until the solenoid 64 is energized.

A U-shaped cover member 81 covers the solenoid 64 and an end plate 121 is connected to the member 81 and is connected to the member 89 by set screws 91. A front cover 122 is attached to the member 81 and a safety switch 66 is mounted to the cover member 122 and has a safety switch 67 which extends through an opening in the cover member 122 so as to disconnect the electrical circuitry to the solenoid 64 so that it will not fire unless the safety switch 66 is in the on position. A pair of batteries E69 and E69′ are also mounted in the U-shape member 81 as well as a resistor R68.

Figure 6:
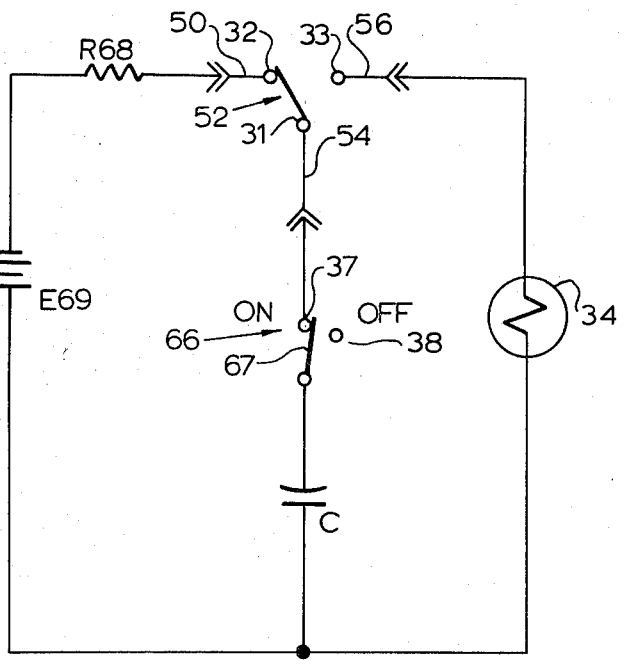
FIG. 6 is an electrical schematic illustrating the operating circuit of the invention.

The electrical circuitry for the pellet gun is illustrated in FIG. 6. The batteries E69, E69′ might be, for example, two nine volt batteries which are connected in series and the positive output terminal is connected to one side of capacitor C and one side of the solenoid 34. The other side of the batteries are connected to one side of the resistor R68 which has its other side connected through a connector to a lead 50 which connects to a contact 32 of a firing switch 31. The other contact 33 of the firing switch is connected by lead 56 to the solenoid 34. A lead 54 is connected to the movable contact 31 of the firing switch and is connected to a contact 37 of the safety switch 66. An open contact 38 engages the safety switch 67 when the safety is in the off position.

Figure 4:
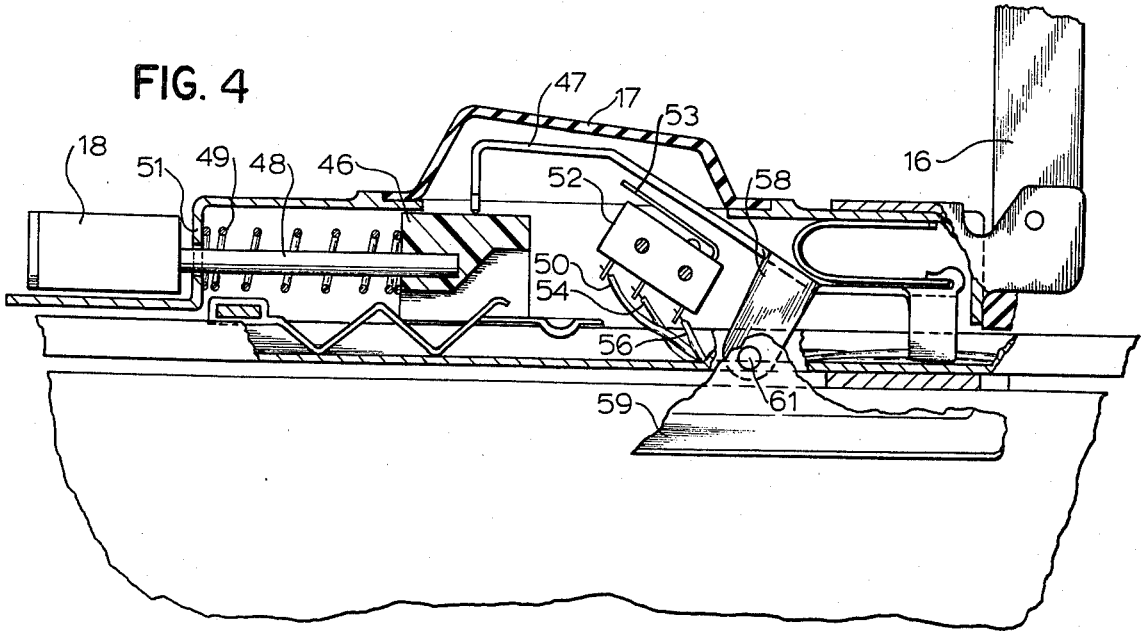
FIG. 4 is a sectional view through the trigger device of the invention.
Figure 5:
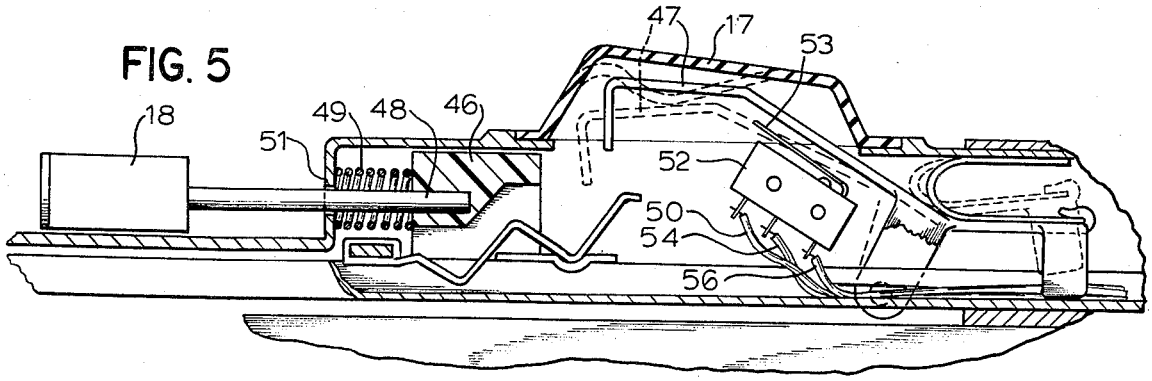
FIG. 5 is a sectional view through the trigger device.

As shown in FIGS. 4 and 5, the firing switch 52 comprises a switch which has an actuator 53 and the switch 52 is mounted under the trigger 47 of the missile launcher 10 and a flexible cover 17 fits over the trigger 47. A mechanical safety 18 is slidably mounted relative to the tube 11 and in FIG. 4 the safety 18 is in the "safe" position so that the trigger 47 cannot be depressed accidentally to fire the weapon. The safety 18 extends into the cover member 51 and has a shaft 48 which carries the cam member 46 which engages the trigger 47. A spring 49 is mounted between the cover member 51 and the safety member 46 as shown. In FIG. 4, the safety is to the right relative to the Figure so the member 46 prevents the trigger 47 from being accidentally depressed to fire the weapon. In FIG. 5, the safety member 18 has been moved to the left so that the member 46 moves out of the path of the trigger 47 so that it can be depressed for firing the weapon. It is to be noted that when the trigger 47 is depressed, it engages the flexible member 53 of the switch 52 which causes the switch to move from the condition wherein the movable contact 31 engages contact 32 to the position where the contact 31 engages the contact 33. When this occurs, a charge which has been accumulated on the capacitor C will be supplied to the solenoid 34 to cause it momentarily to be energized, thus, drawing the sear 96 to a position where the portion 106 clears the projection 104 of the firing cylinder 105 so that it hits the firing pin 108 to actuate the valve 127 thus firing the weapon. It is to be realized, of course, that the safety switch 66 must also be in the on position for firing to occur which is the position illustrated in FIG. 6.

In a particular embodiment according to the invention, the resistor R68 was a one-half watt 1000 ohm resistor. The capacitor C was a 3300 μF 25 volt capacitor.

In use, the soldier can mount a target such as a picture of a tank or other target about 30 feet from the firing position and can open the bolt 79 by rotating it counterclockwise relative to FIG. 3 then drawing bolt 78 back so that a pellet 123 can be inserted into the firing chamber. The bolt 78 is then moved to the left relative to FIG. 2 and the bolt 79 is locked by moving it clockwise to the position shown in FIG. 3. This cocks the firing cylinder 105 so that it is held by the sear 96 away from the firing pin 108. When the soldier desires to fire the weapon, he moves the safety switch 66 to the on position such that contact 67 engages contact 37 and moves the mechanical safety 18 to the position shown in FIG. 5 so that the trigger 47 can be depressed. It is to be noted that the leads 50, 54 and 56 pass from the switch 52 through a tube 50 as shown in FIG. 1 and through a cable 62 down to a connector 135 which can be disassembled from a mating connector 140 to connect the wires 50, 54 and 56 respectively to the resistor 68, the safety switch 66 and the solenoid 34 as shown in the schematic of FIG. 6.

The weapon is fired by holding over the soldier's shoulder in the conventional position for firing the antitank weapon and the soldier uses his sights 16 and 14 to hit the target. After the soldier has completed firing by repeatedlyloading and firing the weapon the target is retrieved for scoring.

It is seen that this invention allows a soldier to practice with an antitank weapon in a simple manner and at very little expense since a firing range only for gas powered pellet guns is required for firing and practicing with the weapon. This is in contrast to the prior art wherein an antitank missile could be fired for practice only under extreme safety conditions and on a very large practice range. The resulting cost and inconvenience of such firing practice results in soldiers receiving relatively small amount of practice. The present invention on the other hand allows the soldier to practice as often as desired since only relatively inexpensive pellets and $CO_2$ cartridges are required for using the invention. Furthermore, only a relatively simple firing range or armory is required for practice with the weapon. Thus, the soldiers will become much more proficient with the use of such weapons.

Although the invention has been described with respect to preferred embodiments, it is not to be so limited as changes and modifications can be made which are within the full intended scope of the invention as defined by the appended claims.

I claim as my invention:

1. A practice weapon comprising a firing tube through which a rocket missile can be fired, a firing trigger mounted on said firing tube, a pellet gun for firing pellets through said tube, means for mounting said pellet gun within said tube and means connecting said firing trigger to said pellet gun for firing it, wherein said pellet gun has a firing sear and includes an electrical solenoid connected to move said firing sear, a battery with one side connected to one side of said solenoid and a first electrical switch actuated by said firing trigger to energize said solenoid, a capacitor with one side connected to said solenoid and said battery, said first electrical switch with its movable contact connected to the other side of said capacitor and movable to a firing position to contact a first contact connected to the second side of said solenoid and movable to engage a second contact connected to engage the second side of said battery for charging said capacitor.

2. A practice weapon according to claim 1 including a second switch connected between the moveable contact of said first switch and the other side of said capacitor.

3. A practice weapon according to claim 2 including a resistor connected between the second side of said battery and said second contact of said first switch.

4. A practice weapon according to claim 1 including a safety for locking said firing trigger and such that when said safety is off said firing trigger is moveable to engage said moveable contact of said first switch to move it from said second contact to said first contact.

* * * * *